US009381928B2

(12) United States Patent
Sengupta et al.

(10) Patent No.: US 9,381,928 B2
(45) Date of Patent: Jul. 5, 2016

(54) SYSTEM AND METHOD FOR GENERATING VEHICLE MOVEMENT PLANS IN A LARGE RAILWAY NETWORK

(71) Applicant: Tata Consultancy Services Limited, Mumbai, Maharashtra (IN)

(72) Inventors: Siddhartha Sengupta, Maharashtra (IN); Sunil D. Joshi, Maharashtra (IN); Shripad Salsingikar, Maharashtra (IN); Sudhir Kumar Sinha, Maharashtra (IN); Kejitan Dontas, Maharashtra (IN); Nishant Kumar Agrawal, Maharashtra (IN)

(73) Assignee: TATA CONSULTANCY SERVICES LIMITED, Mumbai, Maharashtra (IN)

( * ) Notice: Subject to any disclaimer, the term of this patent is extended or adjusted under 35 U.S.C. 154(b) by 0 days.

(21) Appl. No.: 14/712,366

(22) Filed: May 14, 2015

(65) Prior Publication Data

US 2015/0329129 A1 Nov. 19, 2015

(30) Foreign Application Priority Data

May 19, 2014 (IN) ..... 1676/MUM/2014

(51) Int. Cl.
*G06F 19/00* (2011.01)
*B61L 27/00* (2006.01)

(52) U.S. Cl.
CPC ..... *B61L 27/0016* (2013.01); *B61L 27/0005* (2013.01); *B61L 27/0027* (2013.01)

(58) Field of Classification Search
CPC ..... B61L 27/0016; B61L 27/0005; B61L 27/0027
See application file for complete search history.

(56) References Cited

U.S. PATENT DOCUMENTS 4,926,343 A * 5/1990 Tsuruta ..... B61L 27/0016 700/7
5,177,684 A 1/1993 Harker et al.
(Continued)

FOREIGN PATENT DOCUMENTS

CA 2459213 A1 8/2004
WO WO2008131569 A1 * 11/2008 ..... B61L 29/00

OTHER PUBLICATIONS

Markus Friedrich, Gerd Schleupen, Michael Moltenbrey and Hans-Joachim Bungartz; "A Parallel Implementation of a Schedule-Based Transit Assignment Algorithm for Large Networks"; Universität Stuttgart; 2005.
(Continued)

*Primary Examiner* — Calvin Cheung
(74) *Attorney, Agent, or Firm* — Thompson Hine LLP

(57) ABSTRACT

Disclosed is method and system for continuously re-generating reactive on-line train schedules for trains running in a large railway network. Railway network partitioned based on user configuration, into first type comprising trunk line and feeder line sub-networks, and second type comprising supervisory dispatch control territories. Sense and respond cycle is continuously executed on multi-processor computing environment, senses dynamic data from field about train movements, and other changes from users. For each first type sub-network, degree of deviation is computed from incumbent plans and congestion in sub-networks. Using degree of deviation and congestion, trains are rerouted and suitable scheduling methods are chosen for each sub-network and executed in parallel and first level train schedules are sent to second level train schedulers working on second type sub-networks which in parallel identify and resolve conflicts among first level train schedules. Second level train schedules are collated to generate reactive on-line network train schedule.

17 Claims, 11 Drawing Sheets

(56) References Cited

U.S. PATENT DOCUMENTS 5,623,413 A * 4/1997 Matheson ..... B61L 27/0016 104/307
6,377,877 B1 * 4/2002 Doner ..... B61L 17/00 246/122 R
6,459,964 B1 * 10/2002 Vu ..... B61L 27/0016 701/19
6,546,371 B1 * 4/2003 Doner ..... B61L 27/0016 701/117
6,587,738 B1 * 7/2003 Belcea ..... B61L 27/0027 700/33
7,734,383 B2 * 6/2010 Philp ..... B61L 27/0027 246/2 R
2008/0054072 A1 * 3/2008 Katragadda ..... G08G 1/123 235/384

OTHER PUBLICATIONS

Gabrio Curzio Caimi; Algorithmic decision support for train scheduling in a large and highly utilised railway network, 2009.

Yong Cui and Ullrich Martin , "Multi-scale Simulation in Railway Planning and Operation" 2011.

* cited by examiner

SYSTEM AND METHOD FOR GENERATING VEHICLE MOVEMENT PLANS IN A LARGE RAILWAY NETWORK

PRIORITY CLAIM

The present application claims priority to India Provisional Patent Application No. 1676/MUM/2014, filed on May 19, 2014. The entire content of the aforementioned Provisional Patent Application is incorporated herein by reference.

TECHNICAL FIELD

The present subject matter described herein, in general, relates to planning and scheduling of trains in a large size railway network. More particularly, the present subject matter relates to continuously re-generating reactive on-line train schedules for trains running in the large size railway network by interactively partitioning the large size railway network.

BACKGROUND

As needs for freight and passenger transportation is growing over vast area, it is resulting in increasing demands for efficient and larger size railway networks. The large size railway networks have large numbers of stations and connecting the stations with thousands of trains moving on multiple tracks. In the real world, the continuous monitoring and re-planning of the large number of trains in the large railway network is a complex process. Further generation of high-quality, feasible and safe train schedules in the large railway network are extremely hard. In typical scenarios, large numbers of human resources or train dispatchers are engaged in continuously monitoring and controlling of the thousands of trains over the vast networks. Unless the train dispatchers can react rapidly and effectively to mitigate continuous deviations and disruptions, the economic viability of the highly capital-intensive railway industry is adversely impacted.

Train dispatching is of crucial importance in the operations of a railway network because sub-optimal dispatching decisions regarding meeting and passing of the trains greatly degrade throughput, transit times and on-time performance. Dispatching decisions taken with limited local knowledge of railway network adversely impact performance at the overall railway network level. Rail companies differ on relative importance of tactical versus operational planning. The unpredictability of deviations and disruptions on top of day-to-day variability in traffic patterns, often make tactical traffic planning appear like a futile exercise. According to one study, 45% of variance of train arrival times is due to variance in over-the-line transit times. Unfortunately, dispatchers neither have nor can cognitively use the complete network wide information and thus dispatcher's decisions are local and not holistic. The dispatchers locally avoid delaying higher priority trains, often clearing lower priority trains into sidings far in advance of incoming high-priority trains without consideration for network-wide effects. The dispatchers generally use the same heuristics even in abnormal conditions of network congestion and periods of dense traffic, when this strategy can often backfire as delaying a cluster of low priority trains may increase the congestion in which soon all the trains are delayed regardless of the priority of the trains; affecting overall performance of the railway network.

Hence, while the management of large size railway networks needs meticulous planning, the complexity of doing so for large size railway networks may rise uncontrollably with increases in the numbers of stations, sections, trains, and the like. Prior art solutions for railway planning and scheduling fall short in providing efficient management of the trains in such large size railway networks. A number of solutions are proposed in the prior art for automated train planning and scheduling, but all the solutions are restricted to limited numbers of trains and stations. These conventional methods for the railway planning and scheduling handle limited sizes of railway networks and do not provide any solution for planning and scheduling of trains over large railway networks having unconstrained numbers of the trains, stations, platforms and multiple track lines. Prior art solutions cannot be extended to address the efficient and effective planning and scheduling for such large railway networks.

Hence there is a need for an online planning method and system that can dynamically react rapidly and efficiently to continuous traffic delays, deviations and disruptions and other conditions on an on-going basis and holistically and reschedule the very large numbers of trains considering the many interactions over the very large railway network having unconstrained number of the trains, stations, platforms and multiple track lines.

SUMMARY

This summary is provided to introduce aspects related to systems and methods for generating an online reactive train schedule for a large size railway network and the aspects are further described below in the detailed description. This summary is not intended to identify essential features of the claimed subject matter nor is it intended for use in determining or limiting the scope of the claimed subject matter.

In one implementation, a system is disclosed for continuously executing sense and respond cycles to re-generate reactive on-line train schedules for trains running in a railway network by interactively partitioning the railway network. The railway network is a large country wide railway network. The system comprises a set of processors and memory coupled to the set of processors. The system comprises a collection of persistent data storage managed by a database management system coupled to the processors. The set of processors are capable of executing programmed instructions stored in the memory to enable users to configure the partitions of the railway network into first type sub-networks and second type sub-networks and to store the data for the partitions. The user configurable first type sub-networks comprise one or more trunk lines and one or more feeder lines. The set of processors are capable of executing programmed instructions stored in the memory to further enable users to configure groups of one or more feeder line sub-networks into feeder line sub-network groups. The user configurable second type sub-networks comprise one or more supervisory dispatch control territories. The set of processors are also capable of executing programmed instructions stored in the memory to enable users to enter, store and modify static data about the railway network, including of partitions, stations, platforms, loops, and about the trains planned in the network. The geographies of the first type sub-networks and second type sub-networks overlap and the first type sub-networks and second type sub-networks are alternate representations of the same railway network. First type sub-networks may be wholly or partially included in one or more second type sub-networks. The second type sub-networks may contain one or more first type sub-networks, in part or in whole.

The set of processors are capable of executing programmed instructions stored in the memory to continuously execute sense and respond cycles. While executing each sense and respond cycle, the processor senses static data updates and dynamic data from users, and dynamic data corresponding to arrivals and departures of trains at timetable points, from field, received through field data acquisition functionality. A set of processors then respond by analyzing the dynamic data associated with the trains to compute a degree of deviation of the actual status of the trains with respect to an incumbent train schedule for each trunk line sub-network and each feeder line sub-network of the one or more first type sub-networks. The incumbent train schedule is computed in one or more preceding sense and respond cycle or copied from the timetable data. The processor further responds by estimating the congestions in the one or more first type railway subnetworks and identifies trains that can benefit from rerouting and selects the best rerouting option for the trains by comparing congestions in the first type sub-networks. The congestion in the one or more first type sub-networks is computed by comparing the density of traffic to design capacity of the one or more first type sub-networks. The processor then selects one or more first level train scheduling methods from a plurality of first level train scheduling methods relevant to the one or more trunk line sub-networks and the one or more feeder line sub-networks, based on the degree of deviation and congestion. The processor further computes a number of computing processors required to execute the selected one or more first level train scheduling methods for each trunk line sub-network and each feeder line sub-network. The processor further communicates requirement of the number of computing processors to a controller method and receives the allocable number and identities of allocated computing processors from the controller method. The processor further executes, in parallel, the one or more first level train scheduling methods so selected, for each trunk line sub-network and each feeder line sub-network group, and in sequence for each feeder line sub-network in each feeder line sub-network group, on the dynamically allocated computing processors by using updated static data, dynamic data, and advisory information as relevant to each trunk line sub-network and each feeder line sub-network, to generate a first level train schedule for each trunk line sub-network and each feeder line sub-network, wherein the advisory information is received from the one or more preceding sense and respond cycles. On completion of the first level schedules, the processor generates, in parallel, a second level train schedule for each of the one or more supervisory dispatch control territories by executing a second level train scheduling method using the first level train schedule of each trunk line sub-network and each feeder line sub-network to: 1) identify and resolve one or more conflicts among the first level train schedules of the one or more trunk line sub-networks and the one or more feeder line sub-networks and 2) compute advisory information based on resolutions of the one or more conflicts. The advisory information may comprise resource allocations for applicable two or more first level train schedulers. The applicable two or more first level train schedulers may be the first level train schedulers for which the one or more conflicts are resolved. Application of the advisory information prevents recurrence of the one or more conflicts between the applicable two or more first level train schedulers in a next sense and respond cycle. The one or more conflicts occur at junction points of the one or more trunk lines and feeder lines, constituting the one or more first type sub-networks. The processor further collates the second level train schedules for each of the one or more supervisory dispatch control territories to generate a reactive on-line train schedule for the railway network.

In one implementation, a method for interactively partitioning the railway network and continuously executing sense and respond cycles to re-generate reactive on-line train schedules for trains running in the railway network is disclosed. The railway network is a large country wide railway network. The method of configuration of the partitions of the railway network comprises logically breaking up the railway network into first type sub-networks and second type sub-networks. The first type sub-networks and the second type sub-networks are user configurable. The first type sub-networks comprise one or more trunk line sub-networks and one or more feeder line sub-networks. The methods further group one or more feeder line sub-networks into feeder line sub-network groups based on user configuration. The second type sub-networks comprise one or more supervisory dispatch control territories and the one or more supervisory dispatch control territories are user configurable. The geographies of the first type railway sub-networks and second type railway sub-networks overlap and the first type railway sub-networks and second type railway sub-networks are alternate representations of the same railway network. First type sub-networks may be wholly or partially included in one or more second type sub-networks. Second type sub-networks may contain one or more first type sub-networks, in part or in whole. The method further enable users to enter, store and modify static data about the railway network, including of partitions, stations, platforms, loops, and about the trains planned in the network.

The method further comprises executing each sense and respond cycle. Executing each sense and respond cycle comprises sensing static data updates and dynamic data from users and the dynamic data corresponding to arrivals and departures of trains at timetable points, from the field, received through field data acquisition functionality. Executing each sense and respond cycle further comprises responding by analyzing, by a set of processors, the dynamic data associated with the trains to compute a degree of deviation of an actual status of the trains with respect to an incumbent train schedule for each trunk line sub-network of the one or more trunk line sub-networks and each feeder line sub-network of the one or more feeder line sub-networks. The incumbent train schedules are computed in one or more preceding sense and respond cycles or copied from the timetable data. Executing each sense and respond cycle further comprises responding, by estimating congestions in the one or more first type railway sub-networks, and identifying trains that can benefit from rerouting and selecting best rerouting option for the trains by comparing the congestions in the one or more first type railway sub-networks. Executing each respond further comprises selecting, one or more first level train scheduling methods from a plurality of first level train scheduling methods relevant to the one or more trunk line sub-networks and the one or more feeder line sub-networks, based on a degree of deviation and congestion. The congestion in the one or more first type sub-networks is computed by comparing the density of traffic to design capacity of the one or more first type sub-networks. Executing each sense and respond cycle further comprises computing a number of computing processors required for executing selected one or more first level train scheduling methods for each trunk line sub-network and each feeder line sub-network and communicating a request for requirement of the number of computing processors to a controller method. Executing each response further comprises receiving allocable number and identities of dynamically allocated computing processors from the controller method and executing, in parallel, the one or more first level train scheduling methods so selected, for each trunk line sub-network and each feeder line sub-network group, and in sequence for each feeder line sub-network in each feeder line sub-network group, on the dynamically allocated computing processors by using at least one of updated static data, the dynamic data, and advisory information as relevant to each trunk line sub-network and each feeder line sub-network, to generate a first level train schedule for each trunk line sub-network and each feeder line sub-network. The advisory information is received from the one or more preceding sense and respond cycles. On completion of first level schedules, executing each sense and respond cycle further comprises generating, in parallel, by the processor, a second level train schedule for each of the one or more supervisory dispatch control territories by executing a second level train scheduling method using the first level train schedule of each trunk line sub-network and each feeder line sub-network, in parallel, to 1) identify and resolve one or more conflicts among the first level train schedules of the one or more trunk line sub-networks and the one or more feeder line sub-networks and 2) compute the advisory information based on resolutions of the one or more conflicts. The advisory information may comprise resource allocation for applicable two or more first level train schedulers. The applicable two or more first level train schedulers may be the first level train schedulers for which the one or more conflicts are resolved. Application of the advisory information prevents recurrence of the one or more conflicts between the applicable two or more first level train schedulers in a next sense and respond cycle. The one or more conflicts occur at junction points of the one or more lines, trunk and/or feeder, of the one or more first type sub-networks. Executing each sense and respond cycle further comprises collating, by the processor, the second level train schedule for each of the one or more supervisory dispatch control territories to generate a reactive on-line train schedule for the entire railway network.

In one implementation, a computer program product having embodied thereon a computer program for interactively partitioning a railway network and re-generating reactive on-line train schedules for trains running in the railway network is disclosed. The railway network is a large country wide railway network. The computer program comprises interactively partitioning the railway network into first type sub-networks and second type sub-networks. The first type sub-networks and the second type sub-networks are user configurable. The first type sub-networks comprise one or more trunk line sub-networks and one or more feeder line sub-networks. The one or more feeder line sub-networks are grouped into one or more feeder line sub-network groups based on the user configuration. The second type sub-networks comprise one or more supervisory dispatch control territories and the one or more supervisory dispatch control territories are user configurable. The geographies of the first type sub-networks and second type sub-networks overlap and the first type sub-networks and second type sub-networks are alternate representations of the same railway network. First type sub-networks may be wholly or partially included in one or more second type sub-networks. Second type sub-networks may contain one or more first type sub-networks, in part or in whole. The computer program further comprises a program code for managing the static data received from the user, storing and enabling change of the data by the user, the data corresponding to the railway network, its user-configured partitions of two types, stations, tracks and to the trains and their planned timetables.

The computer program further comprises a program code for executing each sense and respond cycle. The computer program further comprises a program code for receiving static data updates and dynamic data from users, and dynamic data corresponding to arrivals and departures of trains at timetable points, from the field. The computer program further comprises a program code for analyzing, by a set of processors, the dynamic data associated with the trains to compute a degree of deviation of the actual status of the trains with respect to an incumbent train schedule for each trunk line sub-network of the one or more trunk line sub-networks and each feeder line sub-network of the one or more feeder line sub-networks. The incumbent train schedule is computed in one or more preceding sense and respond cycle or copied from timetable data. The computer program further responds by estimating the congestions in the one or more first type railway subnetworks and identifies trains that can benefit from rerouting and selects the best rerouting option by comparing the sub-network congestions. The computer program further comprises a program code for selecting, one or more first level train scheduling methods from a plurality of first level train scheduling methods relevant to the one or more trunk line sub-networks and the one or more feeder line sub-networks, based on the degree of deviation and congestion. The congestion in the one or more first type sub-networks is computed by comparing the density of traffic to design capacity of the one or more first type sub-networks. The computer program further comprises a program code for computing a number of computing processors required for executing selected one or more first level train scheduling methods for each trunk line sub-network and each feeder line sub-network. The computer program further comprises a program code for communicating a request for requirement of the number of computing processors to a controller method, and a program code for receiving the number and identities of allocated computing processors from the controller method. The computer program further comprises a program code for executing, in parallel, the one or more first level train scheduling methods so selected, for each trunk line sub-network and each feeder line sub-network group, and in sequence for each feeder line sub-network in each feeder line sub-network group, on the dynamically allocated computing processors by using updated static data, the dynamic data, and advisory information as relevant to each trunk line sub-network and each feeder line sub-network, to generate a first level train schedule for each trunk line sub-network and each feeder line sub-network. The advisory information is received from the one or more preceding sense and respond cycles. Subsequent to generation of the first level schedules, the computer program further comprises a program code for generating, in parallel, a second level train schedule for each of the one or more supervisory dispatch control territories by executing a second level train scheduling method using the first level train schedule of each trunk line sub-network and each feeder line sub-network, in parallel, to 1) identify and resolve one or more conflicts among the first level train schedules of the one or more trunk line sub-networks and the one or more feeder line sub-networks and 2) compute the advisory information based on resolutions of the one or more conflicts. The advisory information may comprise resource allocation for applicable two or more first level train schedulers. The applicable two or more first level train schedulers may be the first level train schedules for which the one or more conflicts are resolved. Application of the advisory information prevents recurrence of the one or more conflicts between the applicable two or more first level train schedulers in a next sense and respond cycle. The one or more conflicts occur at junction points of the one or more lines, trunk and/or feeder, of the first type sub-networks. The computer program further comprises a program code for collating the second level train schedules for each of the one or more supervisory dispatch control territories to generate an on-line train schedule for the entire railway network.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Figure 1:
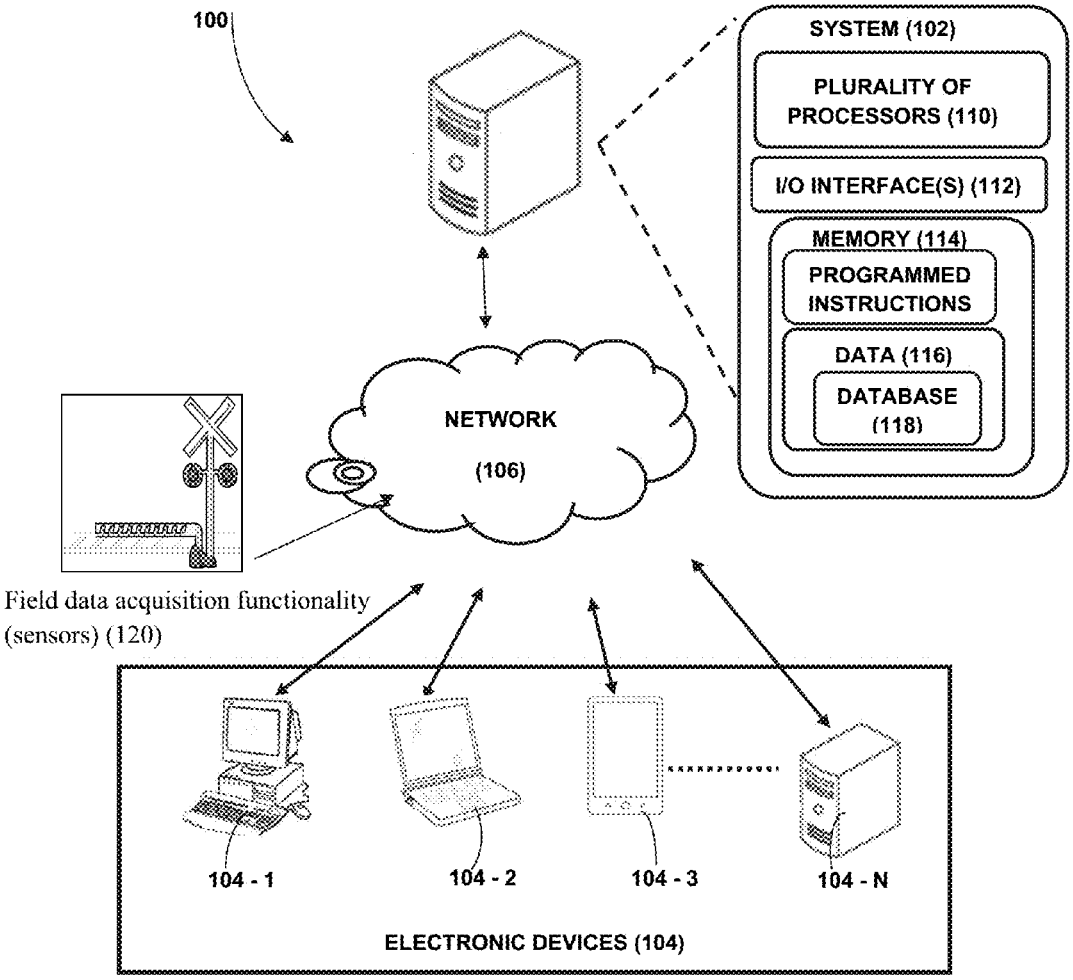
FIG. 1 illustrates a network implementation of a system for interactively partitioning a railway network and re-generating reactive on-line train schedules for trains running in the railway network, and continuously executing sense and respond cycles, in accordance with an embodiment of the present subject matter.

Systems and methods for interactively partitioning a railway network, and continuously executing sense and respond cycles to re-generate reactive on-line train schedules for trains running in the railway network are described. The railway network is a large size countrywide railway network. The railway network may be interactively partitioned into first type sub-networks and second type sub-networks. The first type sub-networks and the second type sub-networks may be user configurable. The first type sub-networks may comprise one or more trunk line sub-networks and one or more feeder line sub-networks. The one or more feeder line sub-networks may be grouped into one or more feeder line sub-network groups, based on the user configuration. The second type sub-networks may comprise one or more supervisory dispatch control territories and are user configurable. The geographies of the first type sub-networks and second type sub-networks overlap and the first type sub-networks and second type sub-networks are alternate representations of the same railway network. First type sub-networks may be wholly or partially included in one or more second type sub-networks. Second type sub-networks may contain one or more first type sub-networks, in part or in whole.

In execution of each sense and respond cycle, static data updates may be received from a user, and dynamic data corresponding to arrivals and departures of trains at timetable points may be received from user and/or from field. The dynamic data corresponding to arrivals and departures of trains may be sensed by sensors from the fields. Further, the dynamic data associated with the trains may be analyzed by a set of processors to compute a degree of deviation of the actual status of the trains with respect to an incumbent train schedule for each trunk line sub-network of the one or more trunk line sub-networks and each feeder line sub-network of the one or more feeder line sub-networks. The incumbent train schedule used above may be computed in one or more preceding sense and respond cycles or copied from the timetable data. Congestion in the one or more first type sub-networks may be computed by comparing the density of traffic to design capacity of the one or more first type sub-networks. The congestion in the one or more first type railway sub-networks may be analyzed by a set of processors to identify trains that can benefit from rerouting and select the best rerouting option by comparing the congestions in the one or more first type sub-networks. Further, one or more first level train scheduling methods may be selected from a plurality of first level train scheduling methods relevant to the one or more trunk line sub-networks and the one or more feeder line sub-networks, based on a degree of deviation and congestion. In next step, a number of computing processors required to execute selected one or more first level train scheduling methods for each trunk line sub-network and each feeder line sub-network may be computed. Further, a request for requirement of the number of computing processors may be communicated and the allocable number and identities of allocated computing processors may be received. Based on the allocable number and identities of allocated computing processors, the computing processors may be allocated in order to execute the one or more first level train scheduling methods so selected, for each trunk line sub-network and each feeder line sub-network.

Subsequent to allocation of the computing processors, the one or more first level train scheduling methods so selected may be executed, in parallel, for each trunk line sub-network and each feeder line sub-network group, and in sequence for each feeder line sub-network in each feeder line sub-network group, on the dynamically allocated computing processors by using updated static data, the dynamic data, and advisory information as relevant to each trunk line sub-network and each feeder line sub-network, to generate a first level train schedule for each trunk line sub-network and each feeder line sub-network. The advisory information may be received from the one or more preceding sense and respond cycles.

After generating the first level train schedules, a second level train schedule for each of the one or more supervisory dispatch control territories may be generated, in parallel, by executing a second level train scheduling method using the first level train schedule of each trunk line sub-network and each feeder line sub-network. The second level train schedule for each of the one or more supervisory dispatch control territories may be generated, in parallel, to identify and resolve one or more conflicts among the first level train schedules of the one or more trunk line sub-networks and the one or more feeder line sub-networks and to compute the advisory information based on resolutions of the one or more conflicts. The one or more conflicts occur at junction points of one or more lines, trunk and/or feeder, of the first type sub-networks. The advisory information may comprise resource allocations for applicable two or more first level train schedulers, and the advisory information prevents recurrence of the one or more conflicts between the applicable two or more first level train schedulers in a next sense and respond cycle. Subsequent to generation of the second level train schedules, the second level train schedules for each of the one or more supervisory dispatch control territories may be collated to generate an on-line train schedule for the railway network.

While aspects of described system and method for interactively partitioning a railway network, and continuously executing sense and respond cycles to re-generate reactive on-line train schedules for trains running in the railway network may be implemented in any number of different networked computing systems, environments, and/or configurations, the embodiments are described in the context of the following exemplary system.

Referring now to FIG. 1, a network implementation 100 of system 102 for interactively partitioning a large railway network, and continuously executing sense and respond cycles to re-generate reactive on-line train schedules for trains running in the railway network is illustrated, in accordance with an embodiment of the present subject matter. In one embodiment, in order to re-generate the reactive on-line train schedules for the trains, the system 102, at first may partition the railway network into first type sub-networks and second type sub-networks. Post partitioning, the system 102 may execute each sense and respond cycle to re-generate reactive on-line train schedules for the trains running in the railway network. In order to execute each sense and respond cycle, the system 102 may receive updated static data from a user, and dynamic data corresponding to arrivals and departures of the trains at timetable points from the user and/or from the field. Further, the system 102 may also receive advisory information as relevant to one or more trunk line sub-networks and/or one or more feeder line sub-networks, from the one or more preceding sense and respond cycles. After receiving the updated static data and the dynamic data and the advisory information, the system 102 may analyze the dynamic data associated with the trains to compute a degree of deviation of the actual status of the trains with respect to an incumbent train schedule for each trunk line sub-network of the one or more trunk line sub-networks and each feeder line sub-network of the one or more feeder line sub-networks. The incumbent train schedule used herein may be computed in one or more preceding sense and respond cycles or copied from the timetable data. The congestions in the one or more first type railway sub-networks may now be estimated to identify trains that can benefit from rerouting and the best rerouting option selected by comparing the congestions in the one or more first type sub-networks.

The system 102 may select one or more first level train scheduling methods from a plurality of first level train scheduling methods relevant to the one or more trunk line sub-networks and the one or more feeder line sub-networks, based on the degree of deviation and congestion. The system 102 may further compute a number of computing processors required to execute the selected one or more first level train scheduling methods for each trunk line sub-network and each feeder line sub-network. Post computing the number of computing processors required, the system 102 may communicate a request for requirement of the number of computing processors and may receive the allocable number and identities of allocated computing processors.

Subsequent to receiving the identities of allocated computing processors, the system 102 may execute, in parallel, the one or more first level train scheduling methods so selected, for each trunk line sub-network and each feeder line sub-network group, and in sequence for each feeder line sub-network in each feeder line sub-network group, on the allocated computing processors by using at least one of updated static data, the dynamic data, and the advisory information as relevant to each trunk line sub-network and each feeder line sub-networks, to generate a first level train schedule for each trunk line sub-network and each feeder line sub-network.

Subsequent to generating the first level train schedules, the system 102 may generate, in parallel, a second level train schedule for each of the one or more supervisory dispatch control territories by executing a second level train scheduling method using the first level train schedule of each trunk line sub-network and each feeder line sub-network. The system 102 may generate the second level train schedule for each of the one or more supervisory dispatch control territories, in parallel, to 1) identify and resolve one or more conflicts among the first level train schedules of the one or more trunk line sub-networks and the one or more feeder line sub-networks and 2) compute the advisory information based on resolutions of the one or more conflicts. The one or more conflicts occur at junction points of one or more lines, trunk and/or feeder, of the first type sub-networks. The advisory information may comprise resource allocations for applicable two or more first level train schedulers, and the advisory information prevents recurrence of the one or more conflicts between the applicable two or more first level train schedulers in a next sense and respond cycle. The applicable two or more first level train schedulers may be the first level train schedulers for which the one or more conflicts are resolved.

Post generating the second level train schedules, the system 102 may collate the second level train schedule for each of the one or more supervisory dispatch control territories to generate a reactive on-line train schedule for the large railway network. The large railway network may be a countrywide railway network.

Although the present subject matter is explained considering that the system 102 is implemented on a server, it may be understood that the system 102 may also be implemented in a variety of multi-processor computing systems. In one implementation, the system 102 may be implemented in a Multiple Instructions Multiple Data (MIMD) environment. In another implementation, the system 102 may be implemented in a cloud environment. It will be understood that the system 102 may be accessed by multiple users through one or more user devices 104-1, 104-2 . . . 104-N, collectively referred to as user devices 104 hereinafter, or applications residing on the user devices 104. Examples of the user devices 104 may include, but are not limited to, a portable computer, a personal digital assistant, a handheld device, and a workstation. The user devices 104 are communicatively coupled to the system 102 through a network 106.

In one implementation, the network 106 may be any combination of high speed, high bandwidth, reliable, robust data network. In one implementation, the network may be an InfiniBand network communications link. In another implementation, the network could be a TCP/IP based network. Further the network 106 may include a variety of network devices, including routers, bridges, servers, computing devices, storage devices, and the like.

Referring now to FIG. 1, the system 102 is illustrated in accordance with an embodiment of the present subject matter. In one embodiment, the system 102 may include a plurality of processors 110, an input/output (I/O) interface 112, and memory 114. The memory (114) could be distributed and shared.

The I/O interface 112 may include a variety of software and hardware interfaces. Further, the I/O interface 112 may enable the system 102 to communicate with other computing devices, database servers, user interfaces and display devices.

The I/O interface 112 can facilitate multiple communications within a wide variety of networks and protocol types.

The memory 114 may include any computer-readable medium known in the art. The memory 114 may include programmed instructions and data 116. The data 116, amongst other things, serves as a repository for storing static data and dynamic data received, processed and generated by execution of the programmed instructions. The data 116 may also include a system database 118.

As shown in FIG. 1, the network implementation 100 of system 102 further comprises field event data acquisition functionality 120. The field event data acquisition functionality 120 further comprises a plurality of sensors distributed and embedded throughout the railway network to sense actual data associated with events occurring in the railway network and corresponding data associated with arrivals and departures of the trains. The field event data acquisition functionality receives field event data from railway SCADA systems and/or user interfaces 104. The system 102 based on the received field event data, may extract arrival and/or departure events at timetable points, and may further partition arrival and/or departure events for each first type sub-network. The system 102 may further update the field events data to the database 118 and may further communicate relevant events to each first type sub-network scheduling and second type sub-network scheduling functionality.

In one implementation, at first, a user may use the client device 104 to access the system 102 via the I/O interface 112. The user may register using the I/O interface 112 in order to use the system 102. The working of the system 102 may be explained in detail below. The system 102 is used for re-generating reactive on-line train schedules for trains running in the railway network.

According to an exemplary embodiment of the present disclosure, the plurality of processors 110 of the system 102 may comprise multiple multi-processor servers working in a parallel or distributed architecture. The plurality of processors 110 may be connected over a communication link 1024. The communication link 1024 may be a high speed communication link. The plurality of processors 110 may be connected using point-to-point or bi-directional serial interconnects. The bi-directional serial interconnects may be selected from InfiniBand, Myrinet, Fibre Channel, PCI Express, Serial ATA, 1GE/10GE, HIPPI OR SCSI with RDMA features, RoCE (RDMA over Converged Ethernet), or iWARP (Internet Wide Area RDMA Protocol). The plurality of processors may be connected using interconnects known to a person skilled in the art. The memory 114 may be distributed or shared and may be coupled to the plurality of processors 110. The memory 114 may comprise the programmed instructions to be dynamically executed by the plurality of processors 110.

Figure 2:
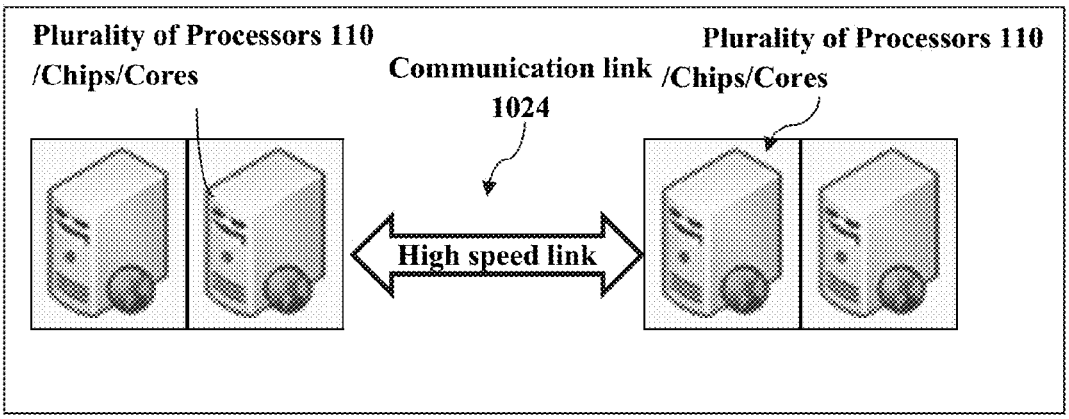
FIG. 2 illustrates a communication link among a plurality of the processors of the system of FIG. 1, in accordance with an embodiment of the present subject matter.

Referring to FIG. 2, the communication link 1024 among the plurality of the processors 110, is illustrated in accordance with an embodiment of the present disclosure. The communication link 1024 may be used for high speed communication while executing the programmed instructions on respective processors/sub-processors/core processors to communicate with each other. The system 102 further comprises a collection of persistent data storage managed by a database management system coupled to the plurality of processors 110.

According to an embodiment of the present disclosure, in order to re-generate reactive on-line train schedules for trains running in the large railway network, at first the system 102 may interactively partition a railway network. In one embodiment, the system 102 may partition the railway network into first type sub-networks and second type sub-networks. The first type sub-networks and the second type sub-networks may be user configurable. The first type sub-networks may comprise one or more trunk line sub-networks and one or more feeder line sub-networks. The first type sub-network may include terminal stations at extremities of the sub-network and may also include several stations and sections between the terminal stations. The system 102 may group the one or more feeder line sub-networks into one or more feeder line sub-network groups, based on the user configuration. The second type sub-networks may comprise one or more supervisory dispatch control territories and the one or more supervisory dispatch control territories may be user configurable. The geographies of the first type sub-networks and second type sub-networks overlap and the first type sub-networks and the second type sub-networks are alternate representations of the same railway network. The first type sub-networks may be wholly or partially included in one or more second type sub-networks. The second type sub-networks may contain one or more first level sub-networks, in part or in whole.

The railway network may be a countrywide railway network of large size for a country like US, India, Japan, China, and the like. In an example, the railway network may comprise thousands of stations and platforms interconnected by thousands of block sections. The railway network may be of unconstrained size. Thousands of trains may run concurrently on the network. The railway network may comprise main lines and feeder lines. The feeder lines connect to the main lines for allowing more people to access the main lines. The main lines may connect major stations of a railway network. The main lines may carry a bulk of the traffic, particularly for longer distances between the major stations. Feeder lines may be of short distance and may carry less traffic. One or more lines, Trunk or Feeder, connect at junction stations.

In one embodiment, user may define the first type sub-networks and second type sub-networks. Further, the junction stations or the nodes in the first type sub-network and the second type sub-network may be understood as the meeting points of two or more trunk lines or feeder lines of first type sub-networks.

Figure 3:
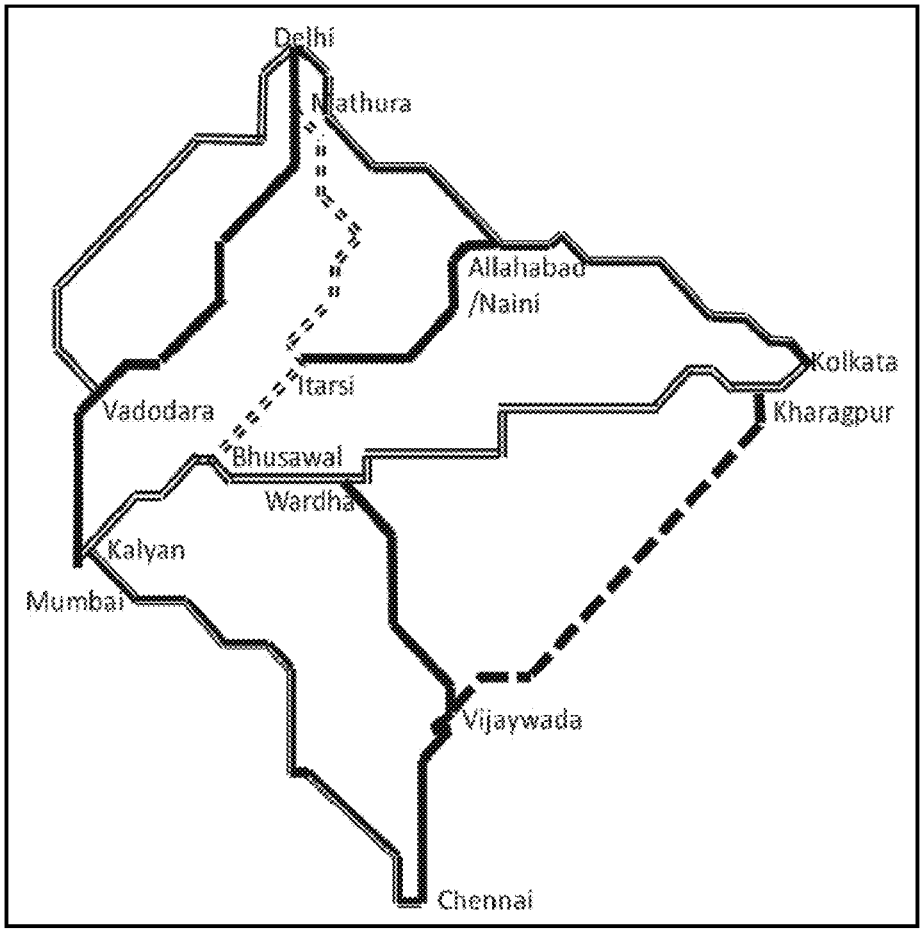
FIG. 3 illustrates partitioning of the railway network into first type trunk line sub-networks, in accordance with an exemplary embodiment of the present subject matter.
Figure 4:
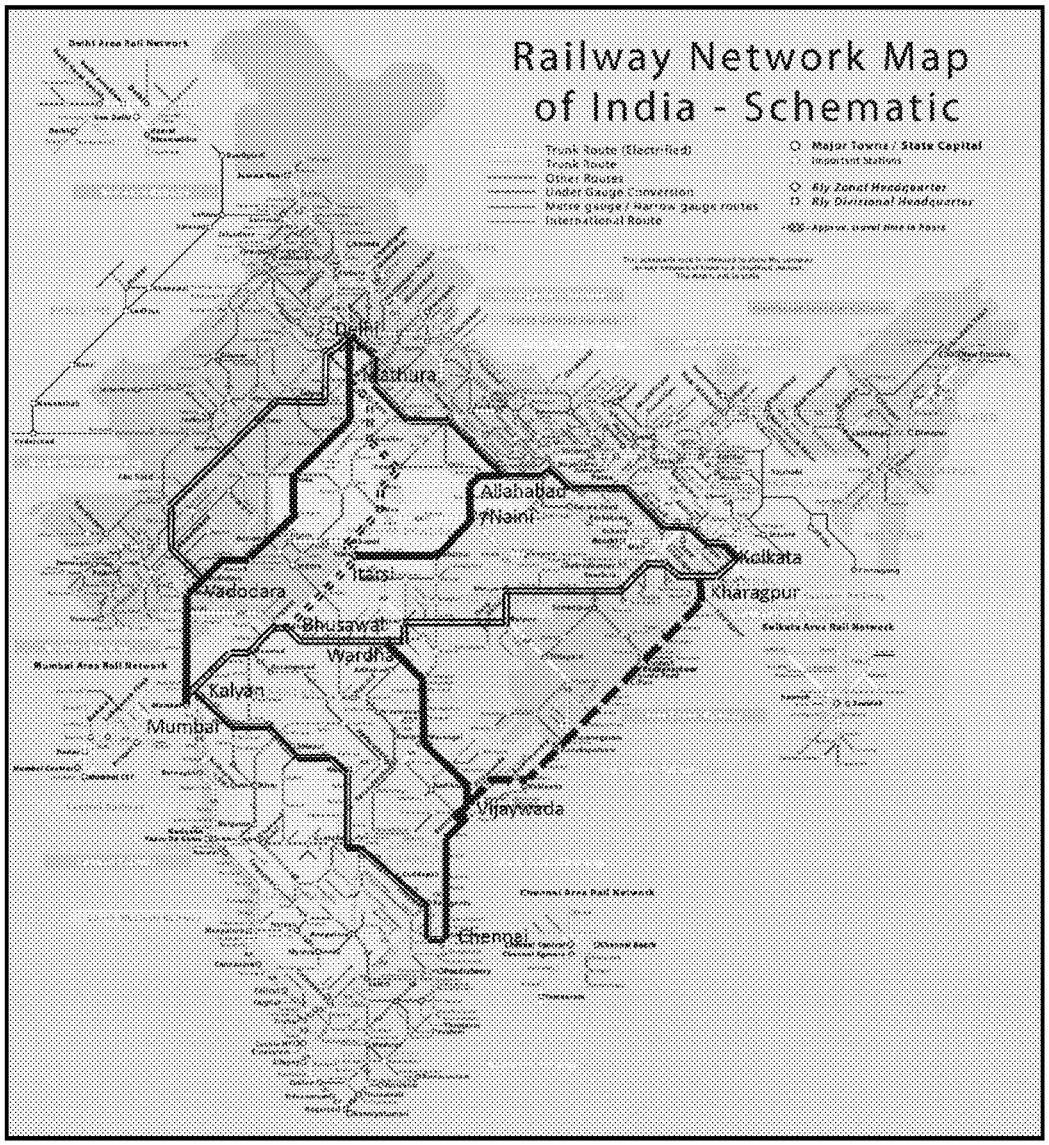
FIG. 4 illustrates partitioning of the railway network into first type trunk line sub-networks and feeder line sub-networks, in accordance with an exemplary embodiment of the present subject matter.

Referring to FIG. 3, in one example, a possible partitioning of the Indian Railway network into first type sub-networks is shown. Each route shown with different style of line shows a trunk line sub-network. For example, Mumbai to Howrah (Kolkata), Kalyan (Mumbai) to Chennai, and Mumbai to Delhi are different possible trunk line sub-networks. Kalyan, Vadodara, Kharagpur are examples of main line junctions. Referring to FIG. 4, in one example, possible partitioning of the railway network into first type sub-networks is shown. Each route shown with different style of line shows trunk and feeder line sub-network. Feeder lines are marked as "Other lines" in the legend. Any country-wide railway network may be partitioned into one or more trunk or main lines and zero or more feeder lines, and connected into a network.

Figure 5:
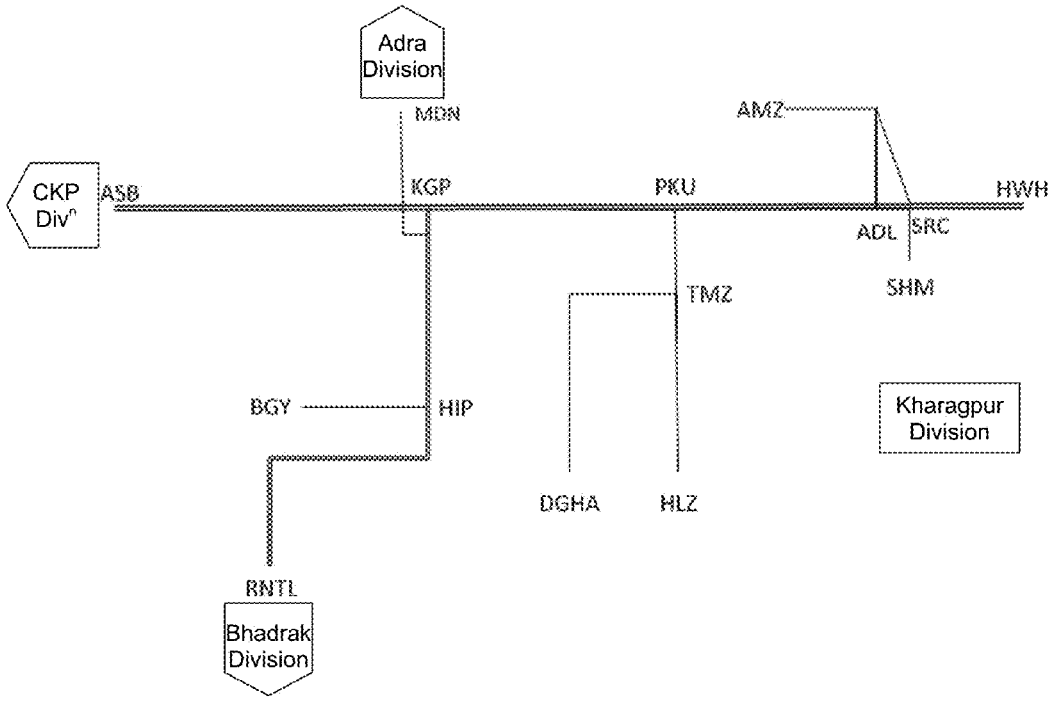
FIG. 5 illustrates partitioning of the railway network into supervisory dispatch control territories, in accordance with an exemplary embodiment of the present subject matter.

Referring to FIG. 5, in one example, partitioning of the railway network into a second type sub-networks is shown. More particularly, referring to FIG. 5, in one example, partitioning of the railway network into supervisory dispatch control territories is shown. In FIG. 5, a possible partitioning of the Indian Railway network into supervisory dispatch control territories is shown. For example, supervisory dispatch control territory of Kharagpur (KGP) Division of South East Railway (SER, Indian Railways) is shown. The acronyms are known in Indian railway literature. Within this partition, the HWH-AHB line segment is part of the possible main line between Howrah (Kolkata) and Mumbai. The KGP-RNTL line-segment is part of the possible main line between Kharagpur and Vijaywada. These two main lines meet at the KGP junction. The PKU-HLZ and HYP BGY lines are examples of possible feeder lines and PKU, TMZ and HIP are their junctions. The other junctions in this example of supervisory control sub-network of Kharagpur Divisional are ADL and SRC. Adra, Chakradharpur (CKP) and Bhadrak Divisional supervisory control areas border the Kharagpur control area and trains are exchanged at the MDN, ASB and RNTL, which need not necessarily be and incidentally are not junction stations.

Figure 6:
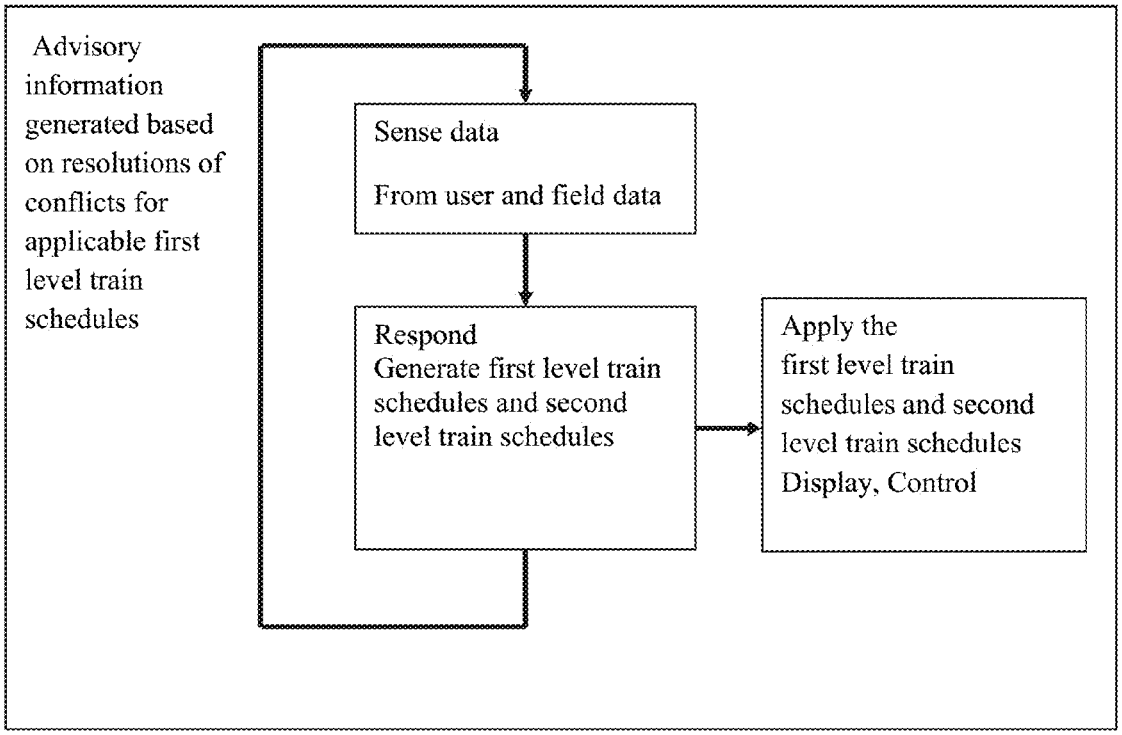
FIG. 6 illustrates execution of a sense and respond cycle, in accordance with an exemplary embodiment of the present subject matter.

In order to re-generate reactive on-line train schedules for trains running in the railway network, subsequent to partitioning, the system 102 may continuously execute sense and respond cycles. Referring to FIG. 6, execution of a sense and respond cycle is explained. The system 102 may reschedule all the trains in the railway network in a continuous and rapid sense and respond cycle. The Respond cycle may have five stages as stated below. In first stage, the system 102 analyzes the 'situation' for each first type sub-network and infer intelligent conclusions about the degree of deviation from incumbent predictions made in the preceding or earlier sense and respond cycle and also the level of congestion. In second stage, the system 102 may use analysis from first stage to decide which train to be rerouted via which route and which scheduling method to apply to which first type sub-network of the railway network. The railway scheduling is implemented in bi-level method. In the third stage, the first level scheduling methods are executed and may locally generate good and feasible plans for each first type sub-network. The second level scheduling methods may work in the fourth stage on the second type sub-networks to remove mutual inconsistencies between the first type train schedules for the first type sub-networks at junctions of the first type sub-networks. The fifth stage, finally accumulates the second level train schedules for the entire railway network. The fifth stage may further compute advisory information from resolutions of the one or more conflicts. The advisory information may comprise resource allocations, for applicable two or more first level train schedulers. The applicable two or more first level train schedulers may be the first level train schedules for which the one or more conflicts are resolved. The advisory information may prevent recurrence of the one or more conflicts between the applicable two or more first level train schedules in a next sense and respond cycle.

At initiation, the system 102 may receive static data from the user. The static data may be predefined and may comprise static railway track data, configuration of the first type sub-networks, configuration of the second type sub-networks, temporary railway track data, temporary railway network modification data, train timetable, thresholds for deviation for each first type sub-network and the like.

The continuously executing sense and respond cycles may comprise sensing static data updates and dynamic data, and responding by providing updated on-line train schedules. While executing each sense and respond cycle, the system 102 may begin by sensing the static data updates from a user, and the dynamic data corresponding to the trains from the field. The dynamic data may comprise actual arrival and departure events of the trains at timetable points and change in the availability of the resources in the railway network. The dynamic data may comprise the advisory information as relevant to one or more trunk line sub-networks and one or more feeder line sub-networks. The advisory information may be received from the one or more preceding sense and respond cycles. The status of the availability of resources associated with the railway network may change dynamically. The resources may comprise the block sections, the stations, the tracks, the platforms and the track loops and the like.

According to an embodiment of the present disclosure, the system 102 may receive dynamic data corresponding to the trains of each of the plurality of first type sub-networks and second type sub-networks in the railway network. The system 102 may receive the static data updates and the dynamic data whenever there are changes in the railway network for each of the plurality of first type sub-networks and second type sub-networks in the system. In system 102 may receive the static data updates and the dynamic data at regular or irregular time intervals. The dynamic data may be acquired through one or more users and a plurality of sensors distributed and embedded throughout the railway network termed as "field."

Subsequent to receiving the static data updates and the dynamic data, in continuously executing sense and respond cycles, the system 102 may further analyze, by using a set of processors, the dynamic data associated with the trains. The system 102 may analyze the dynamic data associated with the trains to compute a degree of deviation of the actual status of the trains with respect to an incumbent train schedule for each trunk line sub-network of the one or more trunk line sub-networks and each feeder line sub-network of the one or more feeder line sub-networks. The incumbent train schedule may be computed in one or more preceding sense and respond cycles or copied from the timetable data.

The system 102 may compute the degree of deviation for each trunk line sub-network and each feeder line sub-network by comparing the dynamic data of actual train arrival or departure events with one or more predicted events contained in the train schedules computed in preceding one or more sense and respond cycles or from the timetable data.

The system 102 may compute the congestion of the one or more first type sub-networks by comparing a density of traffic to design capacity of the one or more first type sub-networks.

Subsequent to the computation of deviation and congestion, the system 102 may select one or more trains based on the deviation of the one or more trains and/or impact by congestion in the railway network and divert the one or more trains by rerouting the one or more trains over less congested sub-networks. In one embodiment, the system 102 may reroute the one or more trains at junctions. In rerouting of the one or more trains, the system 102 may identify the one or more trains at junctions at which rerouting may be considered. The system 102 may further estimate congestion or a delay along alternate routes for each of the identified trains. The system 102 may further reroute the one or more trains by assigning faster or less energy route to the identified trains as per configuration. The system may further obtain consent of the user for rerouting the identified trains.

Subsequent to computation of the degree of deviation, the system 102 may select, based on a degree of deviation and congestion, one or more first level train scheduling methods from a plurality of first level train scheduling methods relevant to the one or more trunk line sub-networks and the one or more feeder line sub-networks. The system 102 may select the one or more first level train scheduling methods for each trunk line sub-network and each feeder line sub-network based on at least one of the degree of deviation between the first threshold and the second threshold, an updated track status, changes in infrastructure and traffic congestion for the first type sub-networks. The first level train scheduling method may be a heuristic or meta-heuristic method based on at least one of priority, degree of deviation and congestion.

In one scenario, for each trunk line sub-network and each feeder line sub-networks where and when the degree of deviation so computed is within a first threshold, the system 102 may adjust and extrapolate the incumbent train schedules computed in the one or more preceding sense and respond cycles to provide reactive on-line train schedules for the trains running in the first type railway sub-network.

In another scenario, for each trunk line sub-network and each feeder line sub-network where and when the degree of deviation is greater than the first threshold but within a second threshold, the system 102 may execute the selected one or more first level train scheduling methods relevant to the first type sub-networks. If the first type sub-network is a trunk line sub-network, then the system 102 may compute the train schedule on the allocated processors in parallel. If the first type sub-network is a feeder line sub-network, then the system 102 may compute in parallel the train schedules for each feeder line sub-network group, and in sequence for each feeder line sub-network in each feeder line sub-network group, on the allocated processors.

Still in another scenario, attributable to one or more disruptive events in one or more first type sub-networks related to at least one of an accident, track blockage, unplanned maintenance and the like, for one or more trunk line sub-network and/or one or more feeder line sub-network, where and when the degree of deviation is greater than the second threshold, the system 102 may assist the user in selecting the best mitigating option and traffic movement plan based on updated static data (static data updates) describing the disruptive event. The decisions on and extents or descriptions of holding, termination or rerouting of existing trains and/or origination of new trains with user-defined priorities and timetables of the trains may be received from the user as updated static data (static data updates) based on such assistance. In another embodiment, when and where the degree of deviation is greater than the second threshold for one or more trunk line sub-network and one or more feeder line sub-network, the system 102 may repeatedly re-compute the train schedules for the affected one or more trunk line sub-networks and the one or more feeder line sub-networks, in parallel to the computations for the other first type sub-networks, based on the user inputs and the other dynamic data on train arrivals and departures received from the field. The 'field' is the railway network area where a plurality of sensors are deployed to sense dynamic data associated with the trains.

In each sense and respond cycle, post selecting the one or more first level train scheduling methods, the system 102, by using a controller method, may compute a number of computing processors required to execute, in parallel or in sequence, the selected one or more first level train scheduling methods for each trunk line sub-network and each feeder line sub-network. In order to compute allocation of the computing processors, the system 102 at first may receive and collect requests for such requirements of the number of computing processors from all the first type sub-networks. Then the system 102 may prioritize the requests based on the number of computing processors required by each request. The system 102 may further plan and communicate the dynamic allocation of the computing processors and associated resources to each request for each first type sub-network, based on the total number of computing processors available at that time. The system 102 may further allocate the computing processors and associated resources to each request from each first type sub-network.

Post computing the number of computing processors required, the system 102 may communicate a request for requirement of the number of computing processors. Subsequent to communicating a request for requirement of the number of computing processors, the system 102 may receive allocable number and identities of allocated computing processors.

Subsequent to receiving the identities of the allocated computing processors, the system may execute, in parallel, the one or more first level train scheduling methods so selected, for each trunk line sub-network and each feeder line sub-network group, and in sequence for each feeder line sub-network in each feeder line sub-network group, on the allocated computing processors by using at least one of updated static data, the dynamic data, and advisory information as relevant to each trunk line sub-network and each feeder line sub-network, to generate a first level train schedule for each trunk line sub-network and each feeder line sub-network. The advisory information may be received from the one or more preceding sense and respond cycles.

Post generating the first level train schedule for each trunk line sub-network and each feeder line sub-network, the system 102 may generate a second level train schedule for one or more supervisory dispatch control territories by executing a second level train scheduling method using the first level train schedule of each trunk line sub-network and each feeder line sub-network, in parallel. The system 102 may generate a second level train schedule for one or more supervisory dispatch control territories, in parallel, to 1) identify and resolve one or more conflicts among the first level train schedules of the one or more trunk line sub-networks and the one or more feeder line sub-networks and 2) compute the advisory information based on resolutions of the one or more conflicts. The one or more conflicts occur at junction points of the one or more trunk lines and feeder lines of the one or more first type sub-networks. The advisory information may comprise resource allocations for applicable two or more first level train schedulers. The advisory information may prevent recurrence of the one or more conflicts between the applicable two or more first level train schedulers in a next sense and respond cycle. The applicable two or more first level train schedulers may be the first level train schedulers for which the one or more conflicts are resolved. The system 102 may resolve the one or more conflicts between the first level train schedules of the one or more trunk line sub-networks and the one or more feeder line sub-networks without modifying an entry time or an exit time of the trains in the one or more supervisory dispatch control territories as scheduled in the first level train schedules. The system 102 may resolve the one or more conflicts between the two or more first level train schedules of the one or more trunk line sub-networks and the one or more feeder line sub-networks based on at least one of a priority, a degree of deviation and the congestion and the advisory information may be computed based on resolution of the one or more conflicts.

In another embodiment, the system 102 may be implemented on a parallel computing environment comprising a plurality of processors, comprising computing servers, chips or cores, and wherein the plurality of processors are physically and functionally integrated with high speed communication links.

In another embodiment, the first level train scheduling methods may comprise a heuristic based N-step look-ahead technique with backtracking. In the heuristic based N-step algorithm with backtracking, the trains may be assigned time to leave current station, time to arrive and depart from next $0 \leq n \leq N$ stations. Lower priority trains may be backtracked and assigned to previous track loop of the dynamically changing resources that may be available for allocation. In another embodiment, depending on the dynamic level of deviation and congestion of a first type sub-network, the first level train scheduling methods may comprise a meta-heuristic that examines in parallel local neighborhoods in the search space for the location and timing of the meets and passes between trains contending for the same track resources. The first level train scheduling methods may comprise one or more configurable parallelizable algorithms to generate more optimal first level train schedules for each selected first type sub-network. The one or more parallelizable algorithms may be dynamically configured to the number of processors that may be dynamically allocated to each first type sub-network depending on the extent of the deviations and disruptions and subsequent processing requirements of the other first type sub-networks in the large railway network. The first level train scheduling methods may be further decomposed for parallel and faster execution without impacting the quality and optimality of the solutions regarding the locations and timings of the meets and passes.

According to an exemplary embodiment of the present disclosure, a first level train scheduling method of the heuristic based N-step look-ahead with backtracking is explained. The heuristic based N-step look-ahead with backtracking comprises step 1 including allocation of two consecutive unary resources viz. a block section and a loop line. A block section is a section between two stations such that reordering of the trains (Crossing and/or precedence) can be done at either of the two stations. The block section is between departing station and next to departing station, in a direction from origin to destination of the train/voyage. The loop line (siding or stabling line where a train can be parked for halt time) is accessible from the block section, at the next station of the departing station. N is an integer number 1 or more which is pre-defined. N=1 is a case where the trains are advanced station by station. A large value of N (more than the number of stations on the route of a vehicle) shows that the train is advanced from the origin or current position to the destination in a single iteration. Backtracking implements releasing the dynamically changing resources allocated to the train and moving the dynamically changing resources back to the previous step(s) and allocating the dynamically changing resources for the previous step(s).

The first level train scheduling method may implement following features for each train of the trains selected for planning, by ordering the trains on basis of priorities and departure times of the trains, at origins of the trains. The features for special embodiment of N=1 are explained. Readers skilled in the art may be able to extrapolate the planning technique for N>1.

The first level train scheduling methods may be so configured to rapidly minimize deviations of scheduled trains from published timetables or maximize throughput of non-timetabled trains ensuring absence of the conflicts, within parameterized duration from the current time, in the use of the resources by the trains taking into account factors like the extent of movement status deviation from plan/schedule and the congestion on sections of the first type sub-networks. The (cumulative) reactive online train schedule for the railway network may include but is not limited to schedules having conflict-free movements of trains, within parameterized duration from the current time, over interrelated voyages of the trains, schedules that are superior to common sense and manually-generated plans, and schedules that are computed as rapidly as occurrence of events within the railway network.

The system 102 may collect and store the data required for re-generating the reactive on-line train schedules for trains running in the railway network in the database 118. The data from database 118 may be implemented on integrated collection of at least one of one or more processors to enable high-speed, high-reliability, high-availability, and security in data management. The database 118 may receive static data updates and dynamic data relating to track, sub-network configurations and thresholds for deviations in first type sub-networks and network and train timetable from the user and field and display the updated data on the user interface. The system 118 may identify trunk line sub-networks, feeder line sub-networks, feeder line sub-network groups, management jurisdictions and timetable points and maintain the information.

The system 102 may further capture field event data from users or may receive the field event data from railway SCADA systems via suitable interfaces and store the field event data in the database 118. The system 102 may further communicate relevant events to each sub-network scheduling methods.

The system 102 may further display the trains and the resources for the railway network in the I/O interface 104. The system 102 may have variety of interactive and configurable user interfaces. The interactive and configurable user interfaces may include train graphs, detail track displays, schematic network displays at different levels of zoom. The interactive and configurable user interfaces may enable users to understand and manage the large size railway network, infrastructure associated with the railway network, and the reactive online train schedules.

In the embodiments discussed above the system and the method enable customizable partitioning of the railway network into first type sub-networks and second type sub-networks, wherein the first type sub-networks and the second type sub-networks are user configurable; and wherein the first type sub-networks comprise one or more trunk line sub-networks and one or more feeder line sub-networks; and wherein one or more feeder line sub-networks are grouped based on the user configuration; and wherein the second type sub-networks comprise one or more supervisory dispatch control territories and the one or more supervisory dispatch control territories are user configurable.

Figure 7:
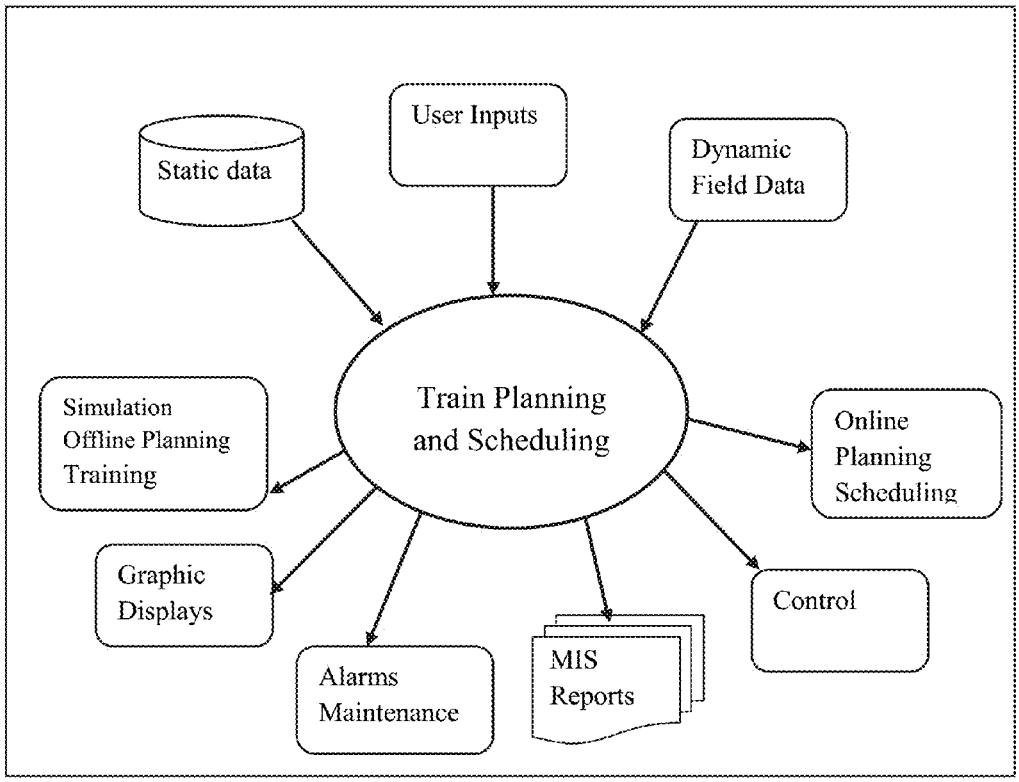
FIG. 7 illustrates an information management process for planning and scheduling of trains in a large size railway network, in accordance with an exemplary embodiment of the present subject matter.

According to an embodiment of the present disclosure, the FIG. 7 illustrates an information management process for planning and scheduling of trains. The system 102 may be configured to provide operations management throughout the railway network by means of a plurality of processors. The system may receive input comprising static data, dynamic data, controller inputs, field data, and advisory information. The system 102 may further process the input data and give output in the form of simulation, planning, training, maintenance alarms, passenger information, MIS reports and graphic displays.

Figure 8:
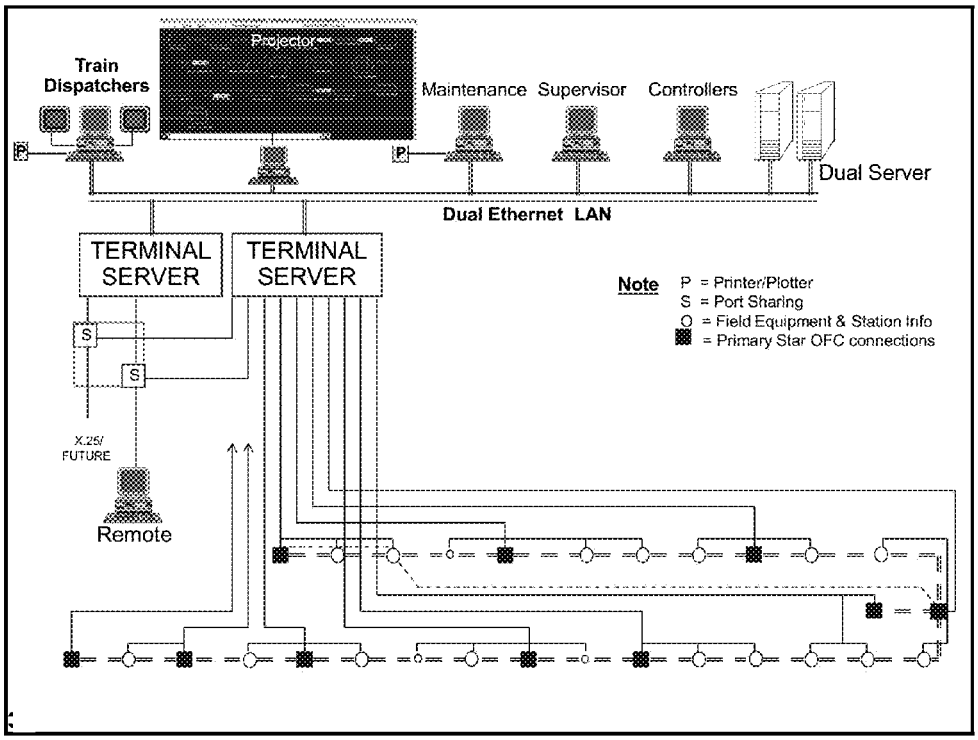
FIG. 8 illustrates a control center layout and a connection of the control center to a field, in accordance with an exemplary embodiment of the present subject matter.

FIG. 8 illustrates a control center layout and a connection of the control center to the field and hardware used in implementation of system 102 in an exemplary embodiment of the disclosure. Hardware components for the control center may only use commercially available equipment. In one example, a minimum of three workstations may be used at each control site for two planners/controllers and a maintenance workstation that communicates over a LAN to a possibly a dual replicated server for fault tolerance. The system 102 may be installed on one or more such servers. These are multi-processor systems on which independent copies of the system 102 may be implemented. Display systems are typically run on different workstations for dispatchers/planners/controllers as depicted in the FIG. 8. The maintenance workstation monitors performance of the control center including the servers, software workstations, displays and communication network (dual Ethernet LAN). The maintenance workstation may also be used as a planner/controller position backup. The functions available in the control center may be controlled by password entry. Moreover, additional workstations can be added to the control center any time. The nature and configurations of the hardware and communications components and user roles as depicted in FIG. 8 are merely indicative. The system 102 is used for vehicle movement modeling in a large size railway network. The system 102 provides adaptive rescheduling of vehicles/trains movement in the railway network. The system ensures absence of conflicts in vehicle movements in the railway network. Further, the system 102 may also generate graphs and visual layouts of vehicle/trains movement over the railway network. The figure illustrates Terminal Servers being used to connect to possible serial devices or parallel devices in the field. Alternate devices like routers, switches and hubs may be used to connect to other and more types of field devices and external systems.

In the embodiments discussed above the system and method enable continuously executing sense and respond cycles to re-generate reactive on-line train schedules for trains running in the railway network.

In the embodiments discussed above the system and method enable scaling up of railway planning and scheduling problem space by at least two orders of magnitude with thousands of trains and thousands of stations, while reducing the planning and scheduling cycle response time by one order of magnitude, to approximately a minute.

In the embodiments discussed above the system and method enable generation of an online reactive train schedule for a country wide railway network that minimizes deviations of operations of the trains from the train schedules and also from tactical plans.

In the embodiments discussed above the system and the method enable grouping one or more feeder line sub-networks based on the user configuration to improve the efficiency of the computations by sequentially scheduling the feeder lines in a group on the same processor within the time it takes to schedule the most complex trunk line sub-network.

In the embodiments discussed above the system and the method enable a bi-level scheduling approach to cover the entire network wherein repeatedly and rapidly the first level generates high-optimality schedules and both levels generate feasible plans.

Figure 9:
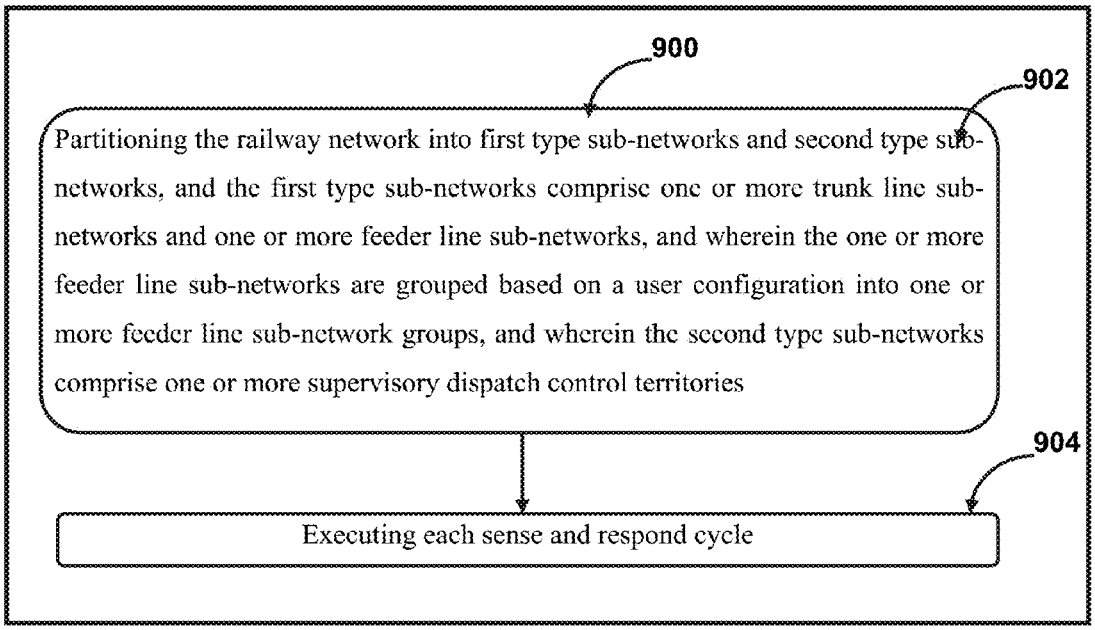
FIG. 9 illustrates a method for generating a reactive online train schedule for a railway network, in accordance with an embodiment of the present subject matter.

Referring now to FIG. 9, a method 900 for re-generating reactive on-line train schedules for trains running in the railway network is described, in accordance with an embodiment of the present subject matter. Referring now to FIG. 9, a method 900 for interactively partitioning a railway network and continuously executing sense and respond cycles to re-generate reactive on-line train schedules for trains running in the railway network is shown, in accordance with an embodiment of the present subject matter. The railway network may be a country wide railway network. The method 900 may be described in the general context of computer executable instructions. Generally, computer executable instructions can include routines, programs, objects, components, data structures, procedures, modules, functions, etc., that perform particular functions or implement particular abstract data types. The method 900 may also be practiced in a distributed computing environment where functions are performed by processing devices that are linked through a fast and reliable communications network. In a distributed computing environment, computer executable instructions may be located in both local and distributed computer storage media, including memory storage devices.

The order in which the method 900 is described is not intended to be construed as a limitation, and any number of the described method blocks can be combined in any order to implement the method 900 or alternate methods. Additionally, individual blocks may be deleted from the method 900 without departing from the spirit and scope of the subject matter described herein. Furthermore, the method can be implemented in any suitable hardware, software, firmware, or combination thereof. However, for ease of explanation, in the embodiments described below, the method 900 may be considered to be implemented in the above described system 102.

At block 902, the railway network may be partitioned into first type sub-networks and second type sub-networks. The first type sub-networks and the second type sub-networks may be user configurable. The first type sub-networks may comprise one or more trunk line sub-networks and one or more feeder line sub-networks. The one or more feeder line sub-networks may be grouped into one or more feeder line sub-network groups based on the user configuration. The second type sub-networks may comprise one or more supervisory dispatch control territories and are user configurable. In one implementation, the railway network may be partitioned into first type sub-networks and second type sub-networks by the system 102. The geographies of the first type sub-networks and second type sub-networks overlap and the first type sub-networks and the second type sub-networks are alternate representations of the same railway network. The first type sub-networks may be wholly or partially included in one or more second type sub-networks. The second type sub-networks may contain one or more first type sub-networks, in part or in whole.

At block 902, user inputs for static data associated with the railway network, stations, tracks, trains and timetables may be received. Further, at block static data about the railway network, including of stations, platforms, loops, and about the trains planned in the network may also be modified. If there is a cold start for the method, static data structures for tracks and trains may be populated and trains may be positioned as per system time, timetable, user inputs, and events. At block, actual data and predicted events may be compared for each first type sub-network. Further track and train status may be updated in the database 118, infrastructure changes input may be analyzed, and sub-network level traffic congestion level may be analyzed. The static data comprises static railway track data, configuration of the first type sub-networks and thresholds for the deviation of status for the first type sub-networks, and configuration of the second type sub-networks, temporary railway track data, temporary railway network modification data, and train timetable and the like. The dynamic data comprises arrivals and departures of the trains at timetable points and availability of resources in the railway network.

At block 902, the static data may be managed by receiving the static data from the user, storing and enabling change of the static data by the user, the data corresponding to the railway network, user-configured partitions of two types of railway sub-network, thresholds for the deviations of the status for the first type sub-networks, stations, tracks and the trains and planned timetables of the trains.

At block 904, each sense and respond cycle may be executed to re-generate reactive on-line train schedules for trains running in the railway network. The method 704 further comprises sensing the static data updates (updated static data) and the dynamic data and responding by providing updated on-line reactive train schedule in the continuous sense and respond cycle. In one implementation, each sense and respond cycle may be executed by the system 102 to re-generate reactive on-line train schedules for the trains running in the railway network. Further, the block 904 may be explained in greater detail in FIG. 10B.

The method 900 may be executed on a parallel computing environment comprising a plurality of processors, and wherein the plurality of processors are physically and functionally integrated with a high speed communication link.

Figure 10A:
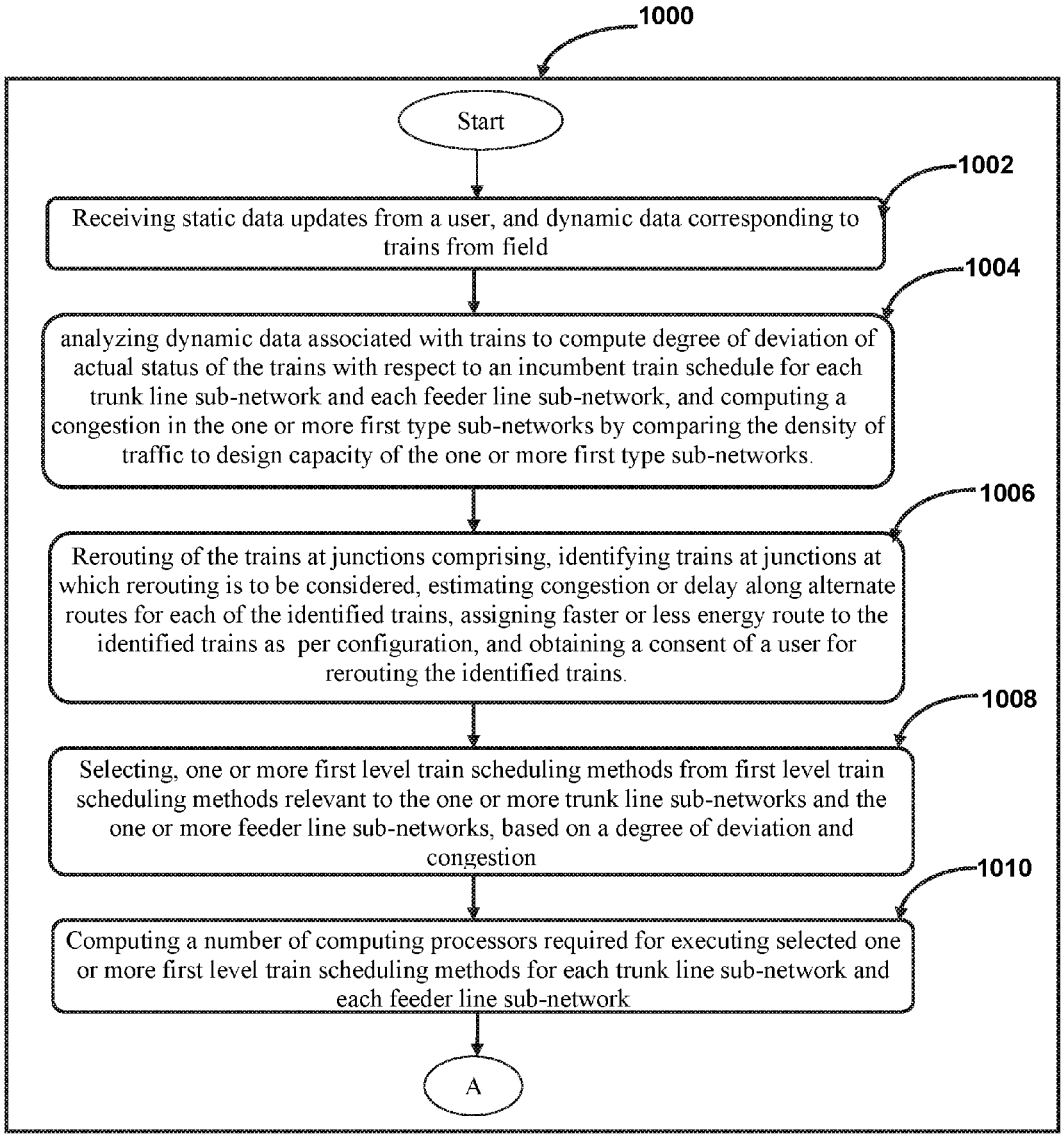
FIGS. 10A and 10B illustrate a method for executing each sense and respond cycle, in accordance with an embodiment of the present subject matter.

Referring now to FIG. 10A, a method block 904 is explained by a method 1000 for executing a sense and respond cycle is shown, in accordance with an embodiment of the present subject matter.

At block 1002, static data updates (updated static data) from one or more users or from the field corresponding to train movements may be received. In one implementation, the static data updates and dynamic data from the user and the dynamic data from the field corresponding to trains may be received by the system 102.

At block 1004, the dynamic data associated with the trains may be analyzed by using a set of processors, to compute a degree of deviation of the actual status of the trains with respect to an incumbent train schedule for each trunk line sub-network of the one or more trunk line sub-networks and each feeder line sub-network of the one or more feeder line sub-networks. The incumbent train schedule may be computed in one or more preceding sense and respond cycles or copied from the timetable data. In one implementation, the dynamic data associated with the trains may be analyzed by using a set of processors by the system 102. At block 804, the dynamic data associated with the trains may be analyzed by using a set of processors, to compute the congestion of the one or more first type sub-networks by comparing the density of traffic to the design capacity.

At block 1004, the degree of deviation for each trunk line sub-network and each feeder line sub-network may be computed by comparing the dynamic data of actual train arrival or departure events with one or more predicted events contained in the train schedules computed in preceding one or more sense and respond cycles or in the timetable data. Further, the congestion in the one or more first type sub-networks is computed by comparing the density of traffic to design capacity of the one or more first type sub-networks.

At block 1006, rerouting of the trains at junctions may be carried out. The rerouting of the trains may comprise, identifying trains at junctions at which rerouting is to be considered, estimating congestion or delay along alternate routes for each of the identified trains, assigning faster or less energy route to the identified trains as per configuration, and obtaining a consent of a user for rerouting the identified trains.

At block 1008, one or more first level train scheduling methods from first level train scheduling methods relevant to the one or more trunk line sub-networks and the one or more feeder line sub-networks may be selected based on at least on a degree of deviation and congestion for that sub-network. In one implementation, the one or more first level train scheduling methods may be selected by the system 102 for the same sub-network in different cycles or for different sub-networks in the same cycle.

The method 1000, at block 1008 further comprises adjusting and extrapolating the incumbent train schedules computed in the one or more preceding sense and respond cycles when the degree of deviation for each trunk line sub-network and each feeder line sub-networks is within a first threshold.

The method 1000, at block 1008 further comprises computing the deviation and congestion in each trunk line sub-network and each feeder line sub-network, and when the degree of deviation for each trunk line sub-network and each feeder line sub-network is greater than the first threshold but within a second threshold, then executing, in parallel, the one or more first level train scheduling methods so selected, relevant to the first type sub-networks, on the dynamically allocated computing processors, for each trunk line sub-network and each feeder line sub-network group, and in sequence for each feeder line sub-network in each feeder line sub-network group, on the allocated computing processors by using the static data update, the dynamic data, and the advisory information as relevant to each trunk line sub-network and each feeder line sub-network, to generate a first level train schedule for each trunk line sub-network and each feeder line sub-network. The advisory information may be received from the one or more preceding sense and respond cycles.

The method 1000, at block 1008 further comprises assisting the train dispatchers to update train schedules to mitigate the impact of the disruptions, when the degree of deviation is greater than the second threshold for each trunk line sub-network and each feeder line sub-network, and wherein the updated train timetable are received from a user, and wherein the updated train timetable is attributable to an event occurred in the railway network related to at least one of an accident, a relief of congestion, an arrival or a departure of a special train.

The method 1000, at block 1008 further comprises selecting the one or more first level train scheduling methods for each trunk line sub-network and each feeder line sub-network based on the degree of deviation between the first threshold and the second threshold, an updated track status, changes in infrastructure and traffic congestion for the first type sub-networks.

The first level train scheduling method may be a heuristic or meta-heuristic method based on at least one of priority, degree of deviation and congestion.

Figure 10B:
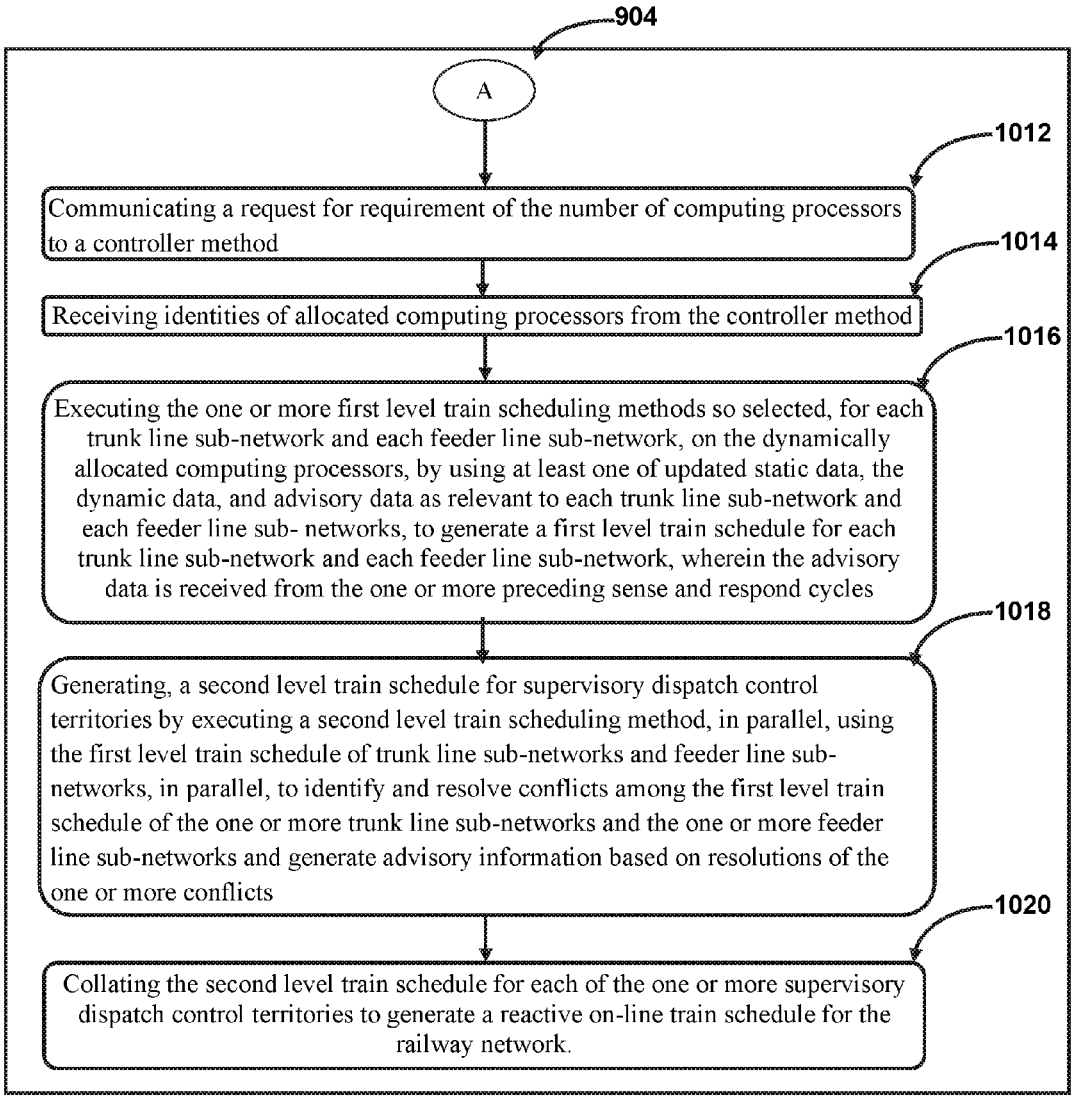

Now with reference to FIG. 10B, at block 1010, a number of computing processors required for executing selected one or more first level train scheduling methods for each trunk line sub-network and each feeder line sub-network may be computed. In one implementation, the number of computing processors required for executing selected one or more first level train scheduling methods may be computed by the system 102.

At block 1012, a request for requirement of the number of computing processors may be communicated to a controller method. In one implementation, the request for requirement of the number of computing processors may be communicated by the system 102.

At block 1012, the controller method further allocates the computing processors required for responding in each sense and respond cycle. The controller method may collect and accumulate requests for requirement of the number of computing processors by each of the first type sub-networks. The controller method may further prioritize the requests to allocate computing processors based on the number of computing processors required by each request and the total number of processors available in total in the system. Further, the controller method may plan and communicate the allocation and identities of the computing processors to each requesting processors. In one implementation, the controller method may be executed by the system 102. In one implementation, identities of allocated computing processors may be received by the system 102.

At block 1014, identities of dynamically allocated computing processors may be received from the controller method.

At block 1016, the one or more first level train scheduling methods so selected, may be executed, in parallel, for each trunk line sub-network and each feeder line sub-network group, and in sequence for each feeder line sub-network in each feeder line sub-network group on the allocated computing processors, by using at least one of the static data update, the dynamic data, and the advisory information as relevant to each trunk line sub-network and each feeder line sub-network, to generate a first level train schedule for each trunk line sub-network and each feeder line sub-network. In one implementation, the one or more first level train scheduling methods so selected, for each trunk line sub-network and each feeder line sub-network group, may be executed and the first level train schedule for each trunk line sub-network and each feeder line sub-network may be generated by the system 102.

At block 1018, a second level train schedule for each of the one or more supervisory dispatch control territories may be generated by executing a second level train scheduling method, using the first level train schedule of each trunk line sub-network and each feeder line sub-network, in parallel, to 1) identify and resolve one or more conflicts among the first level train schedules of the one or more trunk line sub-networks and the one or more feeder line sub-networks and 2) compute the advisory information based on resolutions of the one or more conflicts. The advisory actions may comprise resource allocations. The one or more conflicts may occur at junction points of the one or more lines, trunk and feeder, constituting the one or more first type sub-networks. In one implementation, a second level train schedule for each of the one or more type two sub-networks comprising supervisory dispatch control territories may be generated by the system 102 to identify and resolve the one or more conflicts among the first level train schedule of the one or more trunk line sub-networks and the one or more feeder line sub-networks. The one or more conflicts between/among the first level train schedules of the one or more trunk line and feeder lines may be resolved without modifying an entry time or an exit time of the trains in the one or more supervisory dispatch control territories as scheduled in the first level train schedules and based on at least one of a priority, a degree of deviation, the congestion and the advisory information is computed based on resolution of the one or more conflicts.

At block 1020, the second level train schedule for each of the one or more type two sub-networks comprising supervisory dispatch control territories may be collated to generate a reactive on-line train schedule for the entire railway network. In one implementation, the second level train schedule for each of the one or more type two sub-networks comprising supervisory dispatch control territories may be collated by the system 102 to generate a reactive on-line train schedule for the railway network.

Although implementations for methods and systems for re-generating reactive on-line train schedules for trains running in the railway network have been described in language specific to structural features and/or methods, it is to be understood that the appended claims are not necessarily limited to the specific features or methods described. Rather, the specific features and methods are disclosed as examples of implementations for re-generating reactive on-line train schedules for trains running in the railway network.

We claim:

1. A method for re-generating reactive on-line train schedules for trains running in the railway network, wherein the railway network is a country wide railway network, the method comprises interactively partitioning the railway network, and continuously executing sense and respond cycles, and wherein the partitioning of the railway network comprise:

partitioning the railway network into first type sub-networks and second type sub-networks, wherein the first type sub-networks and the second type sub-networks are user configurable, and wherein the first type sub-networks comprise one or more trunk line sub-networks and one or more feeder line sub-networks, and wherein the one or more feeder line sub-networks are grouped based on a user configuration into one or more feeder line sub-network groups, and wherein the second type sub-networks comprise one or more supervisory dispatch control territories;

and wherein executing each sense and respond cycle comprises:

receiving static data updates from a user, and dynamic data corresponding to trains from field;

analyzing, by a set of processors, the dynamic data associated with the trains to compute a degree of deviation of an actual status of the trains with respect to an incumbent train schedule for each trunk line sub-network of the one or more trunk line sub-networks and each feeder line sub-network of the one or more feeder line sub-networks, wherein the incumbent train schedule is computed in one or more preceding sense and respond cycles or copied from timetable data;

selecting, one or more first level train scheduling methods from first level train scheduling methods relevant to the one or more trunk line sub-networks and the one or more feeder line sub-networks, based on a degree of deviation and congestion;

computing a number of computing processors required for executing selected one or more first level train scheduling methods for each trunk line sub-network and each feeder line sub-network;

communicating a request for requirement of the number of computing processors to a controller method;

receiving identities of dynamically allocated computing processors from the controller method;

executing, in parallel, the one or more first level train scheduling methods so selected, for each trunk line sub-network and each feeder line sub-network group, and in sequence for each feeder line sub-network in each feeder line sub-network group, on the dynamically allocated computing processors by using at least one of updated static data, the dynamic data, and advisory information as relevant to each trunk line sub-network and each feeder line sub-networks, to generate a first level train schedule for each trunk line sub-network and each feeder line sub-network, wherein the advisory information is received from the one or more preceding sense and respond cycles;

generating, in parallel, by the processor, a second level train schedule for each of the one or more supervisory dispatch control territories by executing a second level train scheduling method using the first level train schedule of each trunk line sub-network and each feeder line sub-network, in parallel, to identify and resolve one or more conflicts among the first level train schedules of the one or more trunk line sub-networks and the one or more feeder line sub-networks, and compute the advisory information based on resolutions of the one or more conflicts, and wherein the one or more conflicts occur at junction points of the one or more trunk line sub-networks and the one or more feeder line sub- networks;

collating, by the processor, the second level train schedule for each of the one or more supervisory dispatch control territories to generate a reactive on-line train schedule for the railway network; and displaying the reactive online train schedule on a user interface.

2. The method of claim 1, wherein the continuous sense and respond cycle comprises sensing the dynamic data and responding by providing updated on-line train schedule.

3. The method of claim 1, wherein geographies of the first type sub-networks and second type sub-networks overlap, and the first type sub-networks and second type sub-networks are alternate representations of the same railway network, and wherein the first type sub-networks are wholly or partially included in one or more second type sub-networks, and wherein the second type sub-networks comprises one or more first level sub-networks, in part or in whole.

4. The method of claim 1, wherein the static data comprises static railway track data, configuration of the first type sub-networks, configuration of the second type sub-networks, temporary railway track data, temporary railway network modification data, and train timetable, and wherein the dynamic data comprises arrivals and departures of the trains at timetable points and availability of resources in the railway network, and wherein the advisory information comprises resource allocations for applicable two or more first level train schedules, and application of the advisory information prevents recurrence of the one or more conflicts between the applicable two or more first level train schedules in a next sense and respond cycle.

5. The method of claim 1, wherein the degree of deviation for each trunk line sub-network and each feeder line sub-network is computed by comparing the dynamic data of actual train arrival or departure events with one or more predicted events contained in the train schedules computed in preceding one or more sense and respond cycles.

6. The method of claim 1, wherein the congestion in the one or more first type sub-networks is computed by comparing the density of traffic to design capacity of the one or more first type sub-networks.

7. The method of claim 1 further comprising rerouting of the trains at junctions, wherein the rerouting of the trains comprises:

identifying trains at junctions at which rerouting is to be considered, estimating congestion or delay along alternate routes for each of the identified trains, assigning faster or less energy route to the identified trains as per configuration, and obtaining a consent of a user for rerouting the identified trains.

8. The method of claim 1 further comprises adjusting and extrapolating the incumbent train schedules computed in the one or more preceding sense and respond cycles when the degree of deviation for each trunk line sub-network and each feeder line sub-network is within a first threshold.

9. The method of claim 1, wherein when the degree of deviation for each trunk line sub-network and each feeder line sub-network is greater than the first threshold but within a second threshold, then executing, in parallel, the one or more first level train scheduling methods so selected relevant to the first type sub-networks, on the dynamically allocated computing processors, for each trunk line sub-network and each feeder line sub-network group, and in sequence for each feeder line sub-network in each feeder line sub-network group, on the allocated computing processors, by using at least one of the static data update, the dynamic data, and the advisory information as relevant to each trunk line sub-network and each feeder line sub-network, to generate a first level train schedule for each trunk line sub-network and each feeder line sub-network, wherein the advisory information is received from the one or more preceding sense and respond cycles.

10. The method of claim 1, wherein when the degree of deviation is greater than the second threshold for each trunk line sub-network and each feeder line sub-network, and wherein the updated train timetable are received interactively from a user, and wherein the updates to the train timetable is attributable to an event occurred in the railway network related to at least one of an accident, a relief of congestion, an arrival or a departure of a special train.

11. The method of claim 1 further comprises selecting the one or more first level train scheduling methods for each trunk line sub-network and each feeder line sub-network based on the degree of deviation between the first threshold and the second threshold, an updated track status, changes in infrastructure and traffic congestion for the first type sub-networks.

12. The method of claim 1, wherein the first level train scheduling method is a heuristic or meta-heuristic method based on at least one of priority, degree of deviation and congestion.

13. The method of claim 1, wherein, the one or more conflicts between the first level train schedules of the one or more trunk line and feeder lines are resolved without modifying an entry time or an exit time of the trains in the one or more supervisory dispatch control territories as scheduled in the first level train schedules and based on at least one of a priority, a degree of deviation, the congestion, and the advisory information is computed based on resolution of the one or more conflicts.

14. The method of claim 1 is executed on a parallel computing environment comprising a plurality of processors, and wherein the plurality of processors are physically and functionally integrated with a high speed communication link.

15. The method of claim 1, wherein managing the static data comprises receiving the static data from the user, storing and enabling change of the static data by the user, the data corresponding to the railway network, user-configured partitions of two types of railway network, stations, tracks and the trains and planned timetables of the trains.

16. The method of claim 1 wherein the controller method further allocates the computing processors required for responding in each sense and respond cycle, the controller method further comprises, collecting and accumulating requests for requirement of a number of computing processors by each of the first type sub-networks;

prioritizing the requests to allocate computing processors based on the number of computing processors required by each request and the total number of processors available in total in the system;

planning and communicating allocation and identities of the computing processors to each request.

17. A system for re-generating reactive on-line train schedules for trains running in a railway network, wherein the railway network is a country wide railway network, and the system interactively partition the railway network, and continuously execute sense and respond cycles to re-generate reactive on-line train schedules for the trains running in a railway network; the system comprising:

a set of processors, and a collection of persistent data storage managed by a database management system coupled to the processors, and a collection of memory coupled to the set of processors, wherein the set of processors are capable of executing programmed instructions stored in the memory to:

partition the railway network into first type sub-networks and second type sub-networks, wherein the first type sub-networks and the second type sub-networks are user configurable, and wherein the first type sub-networks comprise one or more trunk line sub-networks and one or more feeder line sub-networks, and wherein the one or more feeder line sub-networks are grouped into one or more groups based on the user configuration, and wherein the second type sub-networks comprise one or more supervisory dispatch control territories, and to manage, store, and make available the static data corresponding the railway network, its partitions, the trains and their timetables;

and execute each sense and respond cycle, and wherein executing each sense and respond cycle comprise, receiving dynamic data corresponding to updated static data and the arrivals and departures of trains;

analyzing the dynamic data associated with the trains to compute a degree of deviation of an actual status of the trains with respect to a train schedule for each trunk line sub-network of the one or more trunk line sub-networks and each feeder line sub- network of the one or more feeder line sub-networks and timetable data, wherein the train schedule is computed in one or more preceding sense and respond cycles;

selecting one or more first level train scheduling methods from first level train scheduling methods relevant to the one or more trunk line sub-networks and the one or more feeder line sub-networks, based on the degree of deviation and congestion;

computing a number of computing processors required to execute selected one or more first level train scheduling methods for each trunk line sub-network and each feeder line sub-network;

communicating a request for requirement of the number of computing processors to a controller method;

receiving identities of allocated computing processors from the controller method;

executing, in parallel, the one or more first level train scheduling methods so selected, for each trunk line sub-network and each feeder line sub-network group, and in sequence for each feeder line sub-network in each feeder line sub-network group, on the dynamically allocated computing processors by using at least one of updated static data, the dynamic data, and advisory information as relevant to each trunk line sub-network and each feeder line sub-network, to generate a first level train schedule for each trunk line sub-network and each feeder line sub-network, wherein the advisory information is received from the one or more preceding sense and respond cycles;

generating a second level train schedule for each of the one or more supervisory dispatch control territories by executing a second level train scheduling method using the first level train schedule of each trunk line sub-network and each feeder line sub-network, in parallel, to identify and resolve one or more conflicts among the first level train schedules of the one or more trunk line sub-networks and the one or more feeder line sub-networks, and compute advisory information based on resolutions of the one or more conflicts, and wherein the one or more conflicts occur at junction points of the one or more trunk line sub-networks and the one or more feeder line sub-networks;

collating the second level train schedules for each of the one or more supervisory dispatch control territories to generate a reactive on-line train schedule for the railway network; and displaying the reactive online train schedule on a user interface.

* * * * *